US007310893B2

(12) United States Patent
Woerdehoff et al.

(10) Patent No.: US 7,310,893 B2
(45) Date of Patent: Dec. 25, 2007

(54) HOUSEHOLD APPLIANCE WITH USER SELECTED DEFAULT SETTINGS

(75) Inventors: Christopher John Woerdehoff, Sawyer, MI (US); Joshua Paul Carroll, St. Joseph, MI (US); Andrew Charles Reck, Watervliet, MI (US); David John Kmet, Paw Paw, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 84 days.

(21) Appl. No.: 10/849,388

(22) Filed: May 19, 2004

(65) Prior Publication Data

US 2005/0257397 A1 Nov. 24, 2005

(51) Int. Cl.
*F26B 19/00* (2006.01)

(52) U.S. Cl. ..... 34/527; 34/562

(58) Field of Classification Search ..... 34/491, 34/495, 497, 496, 475, 499, 524, 526, 527, 34/562; 340/825.22
See application file for complete search history.

(56) References Cited

U.S. PATENT DOCUMENTS

| | | | | |
|---|---|---|---|---|
| 6,098,310 | A * | 8/2000 | Chen et al. | 34/475 |
| 6,122,840 | A * | 9/2000 | Chbat et al. | 34/496 |
| 6,141,887 | A * | 11/2000 | Chen et al. | 34/475 |
| 6,446,357 | B2 * | 9/2002 | Woerdehoff et al. | 34/491 |
| 6,519,871 | B2 * | 2/2003 | Gardner et al. | 34/497 |
| 6,671,916 | B2 | 1/2004 | Herr et al. | |
| 6,845,290 | B1 * | 1/2005 | Wunderlin et al. | 700/208 |
| 7,177,712 | B2 | 2/2007 | Blair et al. | |
| 2003/0115595 | A1 * | 6/2003 | Stevens et al. | 725/32 |
| 2005/0077419 | A1 * | 4/2005 | Thomas et al. | 242/563 |

* cited by examiner

*Primary Examiner*—Jiping Lu
(74) *Attorney, Agent, or Firm*—Michael D. Lafrenz; Clifton Green

(57) ABSTRACT

A household appliance functions according to multiple operating cycles, wherein each operating cycle comprises at least one step characterized by a parameter having a factory-set default value. A user can access a controller of the household appliance through a user interface to simultaneously set new default values for a parameter common to at least two of the multiple operating cycles.

18 Claims, 5 Drawing Sheets

HOUSEHOLD APPLIANCE WITH USER SELECTED DEFAULT SETTINGS

BACKGROUND OF THE INVENTION

1. Field of the Invention

The invention relates generally to a household appliance and particularly to a household appliance having multiple operating cycles with corresponding factory-set default values that can be set to new default values by a user. Further, the invention relates to a method for simultaneously setting new default values of multiple operating cycles in a household appliance.

2. Description of the Related Art

Major household appliances, such as clothes dryers, clothes washers, and dishwashers, typically function according to one or more operating cycles. Each operating cycle comprises a series of steps that essentially correspond to a set of "instructions" telling the household appliance how to execute the operating cycle. For example, a clothes dryer can have multiple drying cycles for particular types of fabric, and the steps of an exemplary drying cycle could be: warm up, dry, and cool down. Each step is defined by certain parameters, such as temperature and time, having an associated setting or value, such as a number or a descriptor.

Typically, the household appliance is provided with factory-set default values for each step of all of the cycles based on empirical data, industry standards, and average user preferences. For example, for household clothes dryers, the factory-set defaults are based on clothing care standards and average user preferences. It is common for the dry times to be selected such that the clothes contain some moisture when the particular dry cycle is completed. In most cases this applies to all of the available dry cycles. Common drying cycles include: Heavy Duty, Permanent Press, Normal, etc.

If a user wants to change a feature of the operating cycle for a single execution of the operating cycle, he or she can commonly temporarily alter that feature through a user interface on the household appliance before or during execution of the operating cycle. When the operating cycle is run again, it will function according to the default values.

However, some users prefer to permanently change a feature of an operating cycle for every use of that operating cycle. In this case, some prior art appliances permit the user to access a controller through the user interface and manually change a default value for one step of an operating cycle to a new default value, such as by entering a particular number. As a result, the user can advantageously configure the operating cycle according to the user's preferences.

However, some users do not fit the "average user" profile and may want to permanently change the default value for all of the cycles. For example, a particular user may like all of their clothes to be "bone dry" (no remaining moisture) for all of the drying cycles. In such a situation, with current dryers, the user would have to individually change the factory-set default values for all of the cycles. The process of individually changing the default values can become cumbersome, annoying, and confusing, especially if the appliance has numerous operating cycles. Thus, it is desirable to permit the user to simultaneously change all of the default values for all of the cycles.

SUMMARY OF THE INVENTION

In a household appliance having multiple operating cycles, with each operating cycle having at least one step characterized by a parameter having a factory-set default value, a method according to the invention for setting a new default value comprises permitting a user of the household appliance to simultaneously set new default values for a parameter common to at least two of the multiple operating cycles.

The simultaneous setting of new default values can comprise selecting a set of default values from multiple sets of default values. The set of default values can be selected through a user interface of the household appliance. Further, the simultaneous setting of new default values can comprise shifting a mean of the parameter common to at least two multiple operating cycles.

The new default values can be simultaneously set for the common parameter in all of the multiple operating cycles. Further, the simultaneous setting of new default values can comprise setting new default values for multiple parameters common to the at least two of the multiple operating cycles.

Each of the multiple operating cycles can be a drying cycle for a household clothes dryer. Each set of default values can contain multiple values for the common parameter, with each value corresponding to one of the drying cycles.

The common parameter can be a DRYING TIME which is the sum of a BASE DRY TIME and an ADD-ON DRY TIME. The value can be an ADDITIONAL DRY TIME that is summed with the DRYING TIME to form a new DRYING TIME. Alternatively, the value can be a DRYING TIME MULTIPLIER. The DRYING TIME can be multiplied by the DRYING TIME MULTIPLIER to form a new DRYING TIME, or the ADD-ON DRY TIME can be multiplied by the DRYING TIME MULTIPLIER, and the product of the ADD-ON DRY TIME and the DRYING TIME MULTIPLIER is summed with the BASE DRY TIME to form a new DRY TIME.

A household appliance according to the invention comprises a controller having a processor; a user interface in operable communication with the controller; and multiple operating cycles, with each operating cycle determined by the controller and having at least one step characterized by a parameter having a factory-set default value. A user of the household appliance can access the controller through the user interface to simultaneously set new default values for a parameter common to at least two of the multiple operating cycles.

The new default values can comprise a set of default values selected from multiple sets of default values preprogrammed into the controller. Further, the common parameter for at least two of the multiple operating cycles has a mean, and the mean shifts when the user simultaneously sets the new default values.

The user can simultaneously set the new default values for the common parameter in all of the multiple operating cycles. Further, the user can simultaneously set new default values for multiple parameters common to the at least two of the multiple operating cycles.

Each of the multiple operating cycles can be a drying cycle for a household clothes dryer. Each set of default values can contain multiple values for the common parameter, with each value corresponding to one of the drying cycles.

The common parameter can be a DRYING TIME, and the controller calculates the DRYING TIME by summing a BASE DRY TIME and an ADD-ON DRY TIME. The value can be an ADDITIONAL DRY TIME, and the controller sums the ADDITIONAL DRY TIME with the DRYING TIME to form a new DRYING TIME. Alternatively, the value can be a DRYING TIME MULTIPLIER. The controller can multiply the DRYING TIME by the DRYING TIME MULTIPLIER to form a new DRYING TIME, or the controller can multiply the ADD-ON DRY TIME by the DRYING TIME MULTIPLIER and sums the product of the ADD-ON DRY and the DRYING TIME MULTIPLIER with the BASE DRY TIME to form a new DRYING TIME.

DESCRIPTION OF THE PREFERRED EMBODIMENTS

Figure 1:
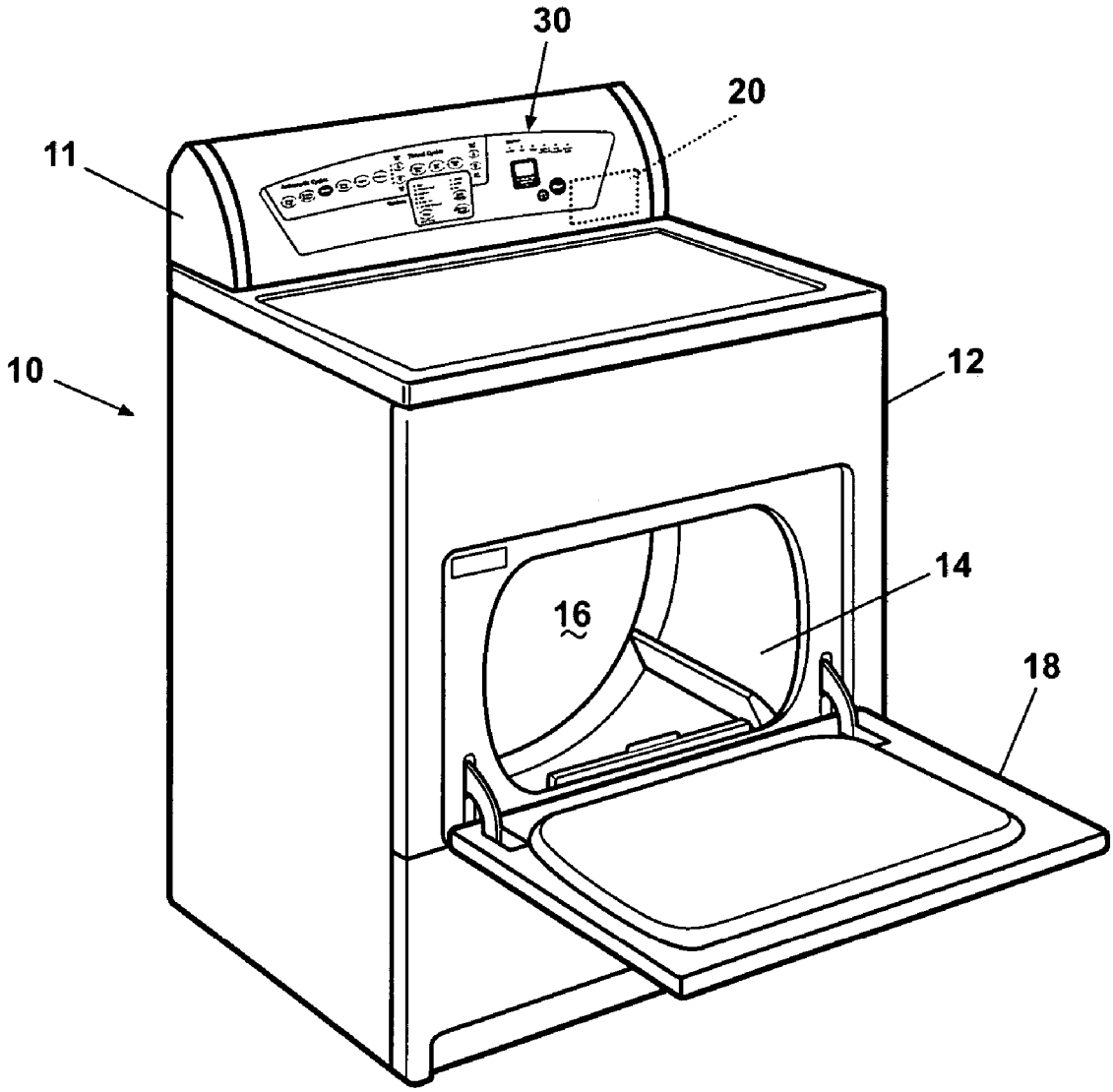
FIG. 1 is a perspective view of a household appliance according to the invention in the form of a dryer comprising a user interface in operative communication with a controller.

Referring now to the figures and particularly to FIG. 1, a household appliance in the form of a dryer 10 comprises a housing 12 that supports a rotatable dryer drum 14 in a conventional fashion. The dryer drum 14 defines a dryer chamber 16 that holds clothes and other items to be dried and is selectively closed by a hinged door 18. During use, ambient air is forced into the dryer chamber 16 by a blower (not shown) while the dryer drum 14 rotates. Before the air enters the dryer chamber 16, it passes a heater (not shown) to heat the air. A controller 20 located inside a control panel 11 mounted to the housing 12 regulates the operation of the blower and heater according to multiple pre-programmed operating cycles and user inputs entered by a user through a user interface 30 located on the exterior of the control panel 11 and in operable communication with the controller 20. Preferably, the controller 20 comprises a processor, such as a microprocessor that functions as a central processing unit.

Each of the multiple operating cycles stored in the controller 20 comprises one or more steps that can be compared to a set of instructions telling the household appliance how to execute each operating cycle. Each step is defined by certain parameters or measurable factors having an associated value or setting. When the dryer 10 is manufactured, the controller 20 is programmed with factory-set or pre-programmed default values for the parameters of the steps in each operating cycle. The default values are selected by the manufacturer in accordance with empirical data, industry standards, and average user preferences as determined by studies, such as consumer focus groups.

Different operating cycles can comprise differing steps, common steps, a different number of steps, the same steps in the same order, or the same steps in a different order. Correspondingly, different steps can be defined by differing parameters or common parameters having the same or differing values. In other words, the operating cycles can comprise any reasonable combination of steps, parameters, and values.

The multiple operating cycles for the dryer 10 are preferably automatic operating cycles that are pre-programmed into the controller 20. Alternatively, the user can manually set a timed operating cycle, wherein the user sets a temperature level and time at the beginning of each timed operating cycle. Exemplary automatic operating cycles for the dryer 10 are drying cycles for different types of fabric or loads, such as heavy duty, jeans, towels, normal, bulky items, casual, and delicate. Exemplary steps for each drying cycle include a warm up step, a drying step, and a cool down step, wherein each of the steps has parameters such as temperature, moisture content, and time. The value for temperature can be, for example, a temperature at which the heater is set or it could be a target temperature for the temperature of the air as sensed by various sensors within the dryer 10. An exemplary value for moisture content is a minimum moisture content as determined by moisture sensors in the drying drum 14. The value for time can be, for example, a desired total duration for the step or a value indicative of a level of dryness preferred by the user. Further, the value can be a verbal descriptor, such as high or low, that corresponds to a range of numerical values. The above cycles, steps, parameters, and values are all provided for exemplary purposes and are not intended to limit the invention in any manner.

Figure 2:
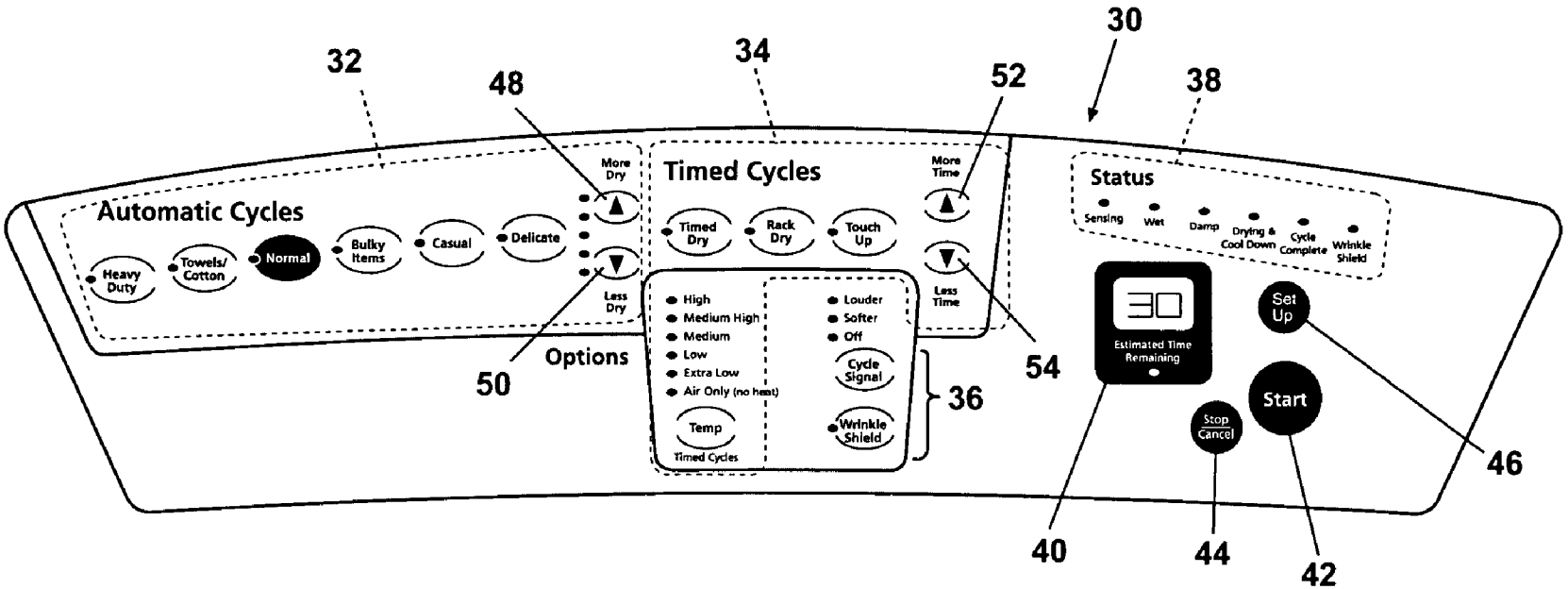
FIG. 2 is a enlarged view of the user interface from the dryer shown in FIG. 1.

Referring now to FIG. 2, the user interface 30 comprises several groups of buttons for the user to input preferences relating to the operating cycles and indicators that display the user's preferences and operational status of the dryer 10. In particular, the user interface 30 comprises an automatic operating cycle button group 32, a timed operating cycle button group 34, an additional options button group 36, a status indicator group 38, an alphanumerical display 40, a start button 42, a stop/cancel button 44, and a setup button 46. The automatic operating cycle button group 32 comprises a button corresponding to each operation cycle, and in this case, the operation cycles correspond to different types of fabric and loads. The automatic operation cycle button group 32 further comprises a more dry button 48 and a less dry button 50 for the user to input a desired dryness level for a single running of the operation cycle. The timed operation cycle button group 34 comprises buttons corresponding to types of timed operation cycles and for selecting a temperature for the timed operation cycle. Additionally, the timed operation cycle button group 34 includes a more time button 52 and a less time button 54 for setting the time of the timed operation cycle. The status indicator group 38 comprises several indicator lights that communicate to the user the operational status of the dryer 10. Operational status data containing numbers and letters, such as an estimated time remaining in the operation cycle, can be indicated in the alphanumerical display 40. Further, the alphanumerical display 40 can be used in conjunction with the setup button 46 for accessing the controller 20 to set new default values for the multiple operating cycles, as described in detail hereinafter. When the user's preferences differ from those used to determine the factory-set default values, the user can access the controller 20, such as through the user interface 30, to set new default values.

The factory-set default values are stored in the controller 20 as a set of default values for a particular parameter common to at least two of the multiple operating cycles. The quantity of values in the set of default values corresponds to the number of the multiple operating cycles having the common parameter. To change the factory-set default values, the user essentially replaces the entire set of default values with a new set of default values so that the values for the common parameter are changed for every operating cycle having that common parameter. Hence, the user can simultaneously set the new default values for the operating cycles having the common parameter, which could be all of the multiple operating cycles.

Preferably, multiple sets of default values are stored in the controller 20 so that a user can incrementally change the set of default values according to the user's preferences. For example, if the user prefers that the contents of the dryer 10 are dried to a level slightly greater than that achieved by the factory-set default values, the user can select a first new set of default values from the multiple sets of default values. The first new set of default values slightly increases the level of dryness, such as by increasing drying time. If the user prefers that the contents of the dryer 10 are dried to a level significantly greater than that achieved by the factory-set default values, the user can select a second new set of default values that significantly increases the level of dryness, and so on. The number of sets of default values stored in the controller 20 is determined by the quantity and magnitude of incremental changes desired by the manufacturer.

As stated above, the sets of default values can comprise values for one parameter common to at least two of the multiple operating cycles. Alternatively, the sets of default values can contain values for multiple common parameters. In the latter case, the user can simultaneously change the default values for multiple parameters in the operating cycles having that parameter. For example, the set of default values can comprise the values for time of a drying step, temperature of a drying step, and time of a cool down step for all of the multiple operating cycles. Hence, in one step, the user can change all of these values for all of the multiple operating cycles.

Because the user selects the new default values as a set of default values that is programmed into the controller 20, the degree to which the default values can be altered is limited. As a result, the user cannot excessively increase or decrease the default values. Such limitations avoid damage to the dryer 10 or ineffective and inefficient operating cycles.

An exemplary description of methods for employing the factory-set default values and the new default values follows. These methods are presented in part for illustrative purposes and are not intended to limit the invention in any manner. It is within the scope of the invention to utilize other methods for employing the factory-set and new default values.

The multiple operating cycles of the dryer 10 comprise the common parameter DRYING TIME. DRYING TIME is the total duration of a drying step in the drying cycle for a particular type of fabric. The DRYING TIME is the sum of a BASE DRY TIME and an ADD-ON DRY TIME. The BASE DRY TIME is a drying period that initiates at the beginning of the drying step and ceases when a measured quantity, such as moisture content, reaches a predetermined threshold. The ADD-ON DRY TIME is an estimated additional drying period having a duration determined by, for example, a lookup table or a fuzzy logic controller. The default value for the DRYING TIME is applied to the DRYING TIME to form a new DRYING TIME having a new total duration for the drying step. The new DRYING TIME replaces the DRYING TIME as the parameter for the drying step.

The default value, whether the factory-set default value or the new default value, can be applied to the DRYING TIME to form the new DRYING TIME in any suitable manner. In a Method A of calculating the new DRYING TIME, the default value is a DRYING TIME MULTIPLIER that is multiplied with the DRYING TIME. In a Method B of calculating the new DRYING TIME, the default value is a DRYING TIME MULTIPLIER that is multiplied to the ADD-ON DRY TIME, and the product of the DRYING TIME MULTIPLIER and the ADD-ON DRY TIME is summed with the BASE DRY TIME. In a Method C of calculating the new DRYING TIME, the default value is an ADDITIONAL DRY TIME that is added to the DRYING TIME. However, it is within the scope of the invention for the factory-set default value to be greater than or less than 1. Formulas corresponding to the Method A, the Method B, and the Method C of determining the new DRYING TIME are:

new DRYING TIME=(DRYING TIME)*(DRYING TIME MULTIPLIER) Method A new DRYING TIME=BASE DRY TIME+[(ADD-ON DRY TIME)*(DRYING TIME MULTIPLIER)] Method B new DRYING TIME=(DRYING TIME)+(ADDITIONAL DRY TIME) Method C Each of the methods forms the new DRYING TIME in a different manner, and the preferred method depends on a desired output and a desired level of programming required for implementation. For example, Method C is the least complicated and is the least software-intense method; however, the ADDITIONAL DRY TIME added to or subtracted from the DRYING TIME does not depend on any real-time data in the dryer 12 and is not responsive to actual conditions of the dryer contents. Conversely, for Methods A and B, the amount of time added to or subtracted from the DRYING TIME is highly dependent on the conditions of the dryer contents, but Methods A and B are more software-intense than Method C.

Preferably, the factory-set default value for the DRYING TIME for all of the multiple cycles equals 1 when the DRYING TIME is the DRYING TIME MULTIPLIER and equals 0 when the DRYING TIME is the ADDITIONAL DRY TIME. These factory-set default values do not affect the DRYING TIME, and, thus, the new DRYING TIME equals the DRYING TIME.

Exemplary sets of default values for use with Methods A, B, and C are provided in Tables I, II, and III, respectively. The new DRYING TIMEs calculated by using these values and the above formulas in conjunction with exemplary BASE DRY TIME and ADD-ON DRY TIME quantities given in Table IV are shown graphically in FIGS. 3-5. In these examples, the multiple operating cycles correspond to drying cycles for the following types of dryer contents: heavy duty, towels/cotton, normal, casual, and delicate.

TABLE I

Exemplary Sets of Default Values for Multiple Operating Cycles for Method A

| Set of Default Values | Heavy Duty | Towels/Cotton | Normal | Casual | Delicate |
|---|---|---|---|---|---|
| 1 (factory-set) | 1 | 1 | 1 | 1 | 1 |
| 2 | 1.15 | 1.15 | 1.1 | 1.1 | 1.1 |
| 3 | 1.3 | 1.3 | 1.25 | 1.2 | 1.2 |

TABLE II

Exemplary Sets of Default Values for Multiple Operating Cycles for Method B

| Set of Default Values | Heavy Duty | Towels/Cotton | Normal | Casual | Delicate |
|---|---|---|---|---|---|
| 1 (factory-set) | 1 | 1 | 1 | 1 | 1 |
| 2 | 1.4 | 1.4 | 1.35 | 1.3 | 1.3 |
| 3 | 1.8 | 1.6 | 1.6 | 1.5 | 1.5 |

TABLE III

Exemplary Sets of Default Values for Multiple Operating Cycles for Method C

| Set of Default Values | Heavy Duty | Towels/Cotton | Normal | Casual | Delicate |
|---|---|---|---|---|---|
| 1 (factory-set) | 1 | 1 | 1 | 1 | 1 |
| 2 | 10 | 15 | 8 | 6 | 5 |
| 3 | 15 | 20 | 12 | 10 | 8 |

TABLE IV

Exemplary BASE DRY TIME and ADD-ON DRY TIME for Multiple Operating Cycles

| Set of Default Values | Heavy Duty | Jeans | Normal | Casual | Delicate |
|---|---|---|---|---|---|
| BASE DRY TIME | 45 | 40 | 30 | 25 | 20 |
| ADD-ON DRY TIME | 10 | 8 | 6 | 4 | 2 |

Figure 3:
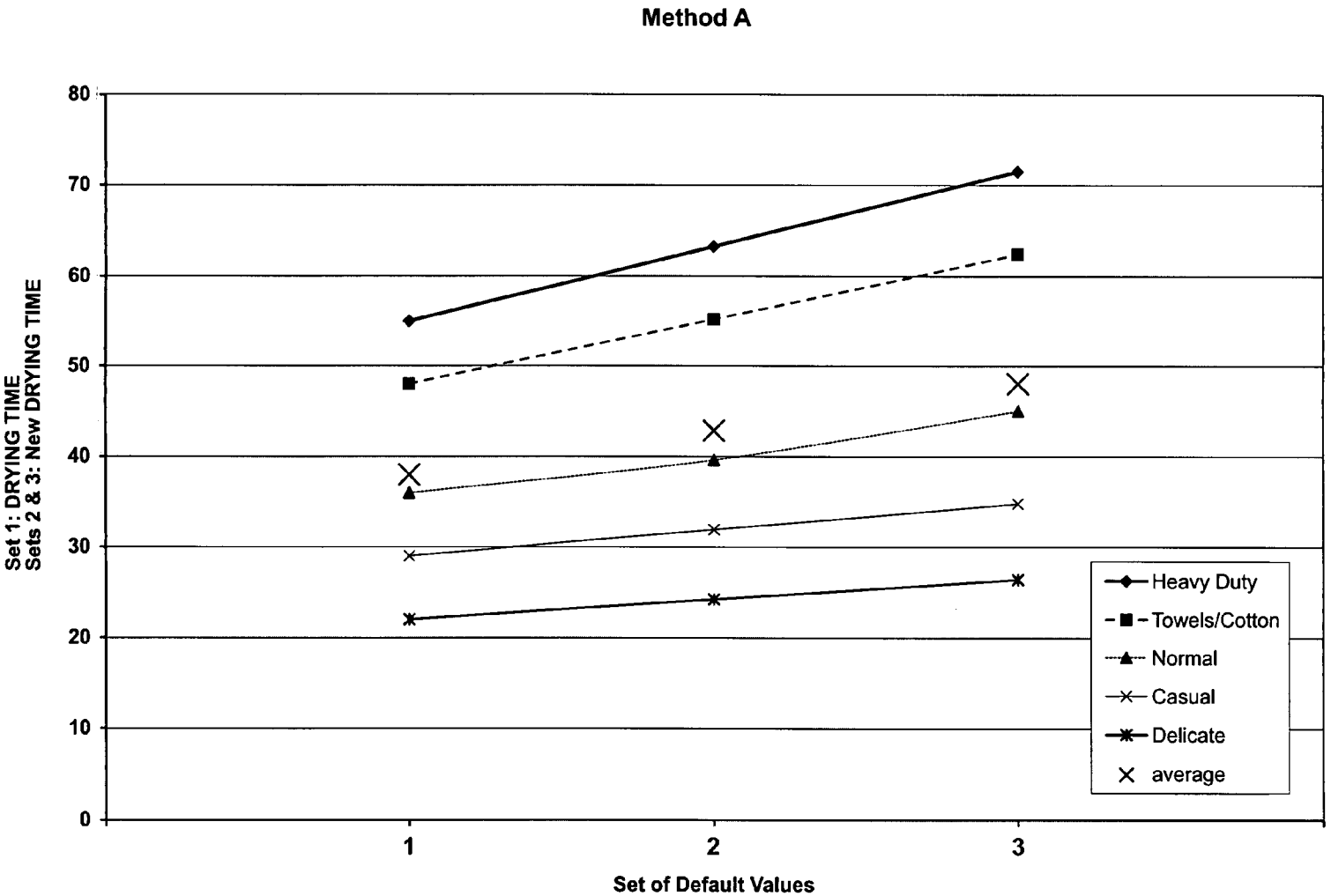
FIG. 3 is a graph depicting exemplary DRYING TIMES and new DRYING TIMES for multiple operating cycles as a function of multiple sets of default values, wherein the DRYING TIMES and new DRYING TIMES are determined according to a Method A.
Figure 4:
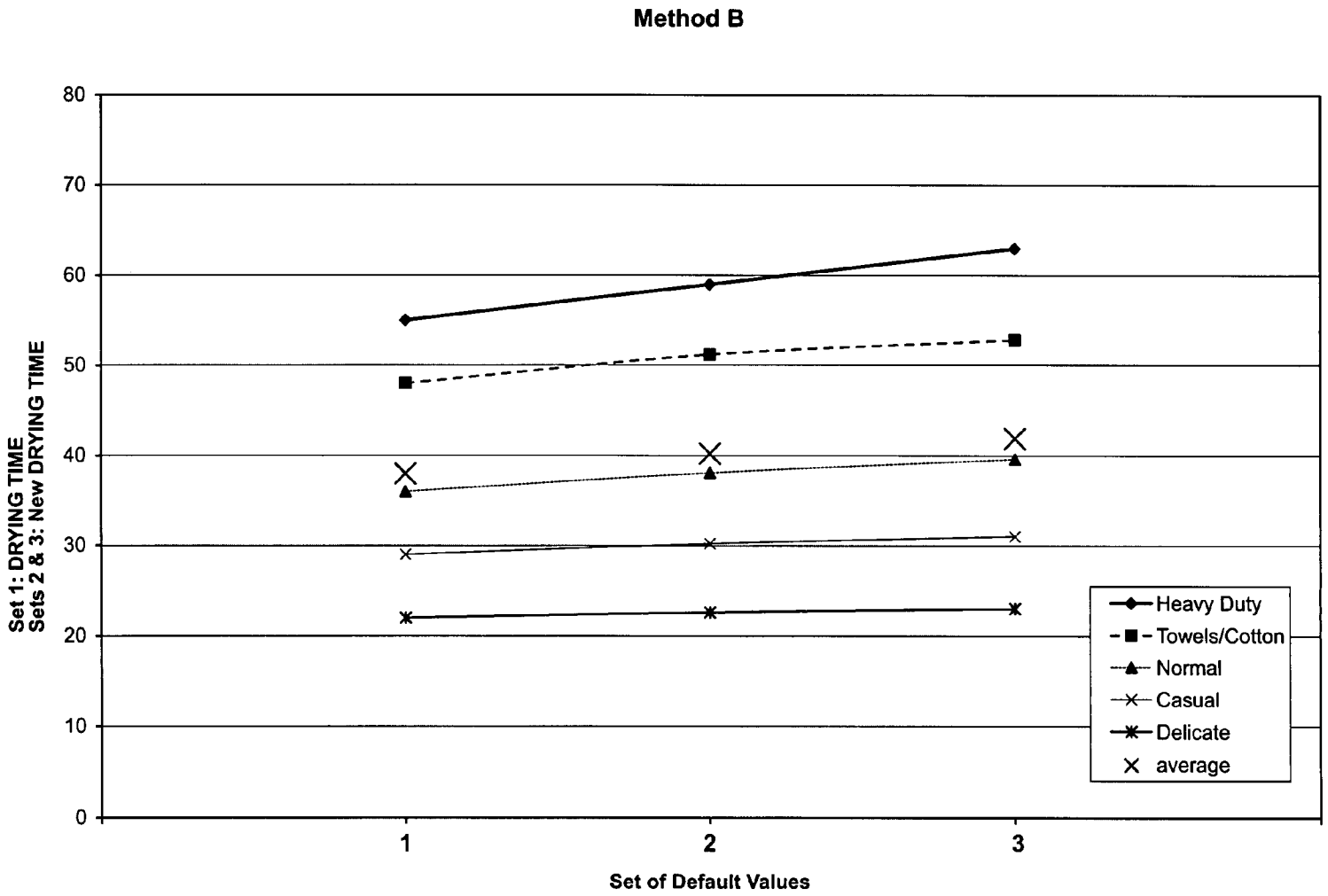
FIG. 4 a graph similar to FIG. 3, wherein the DRYING TIMES and new DRYING TIMES are determined according to a Method B.
Figure 5:
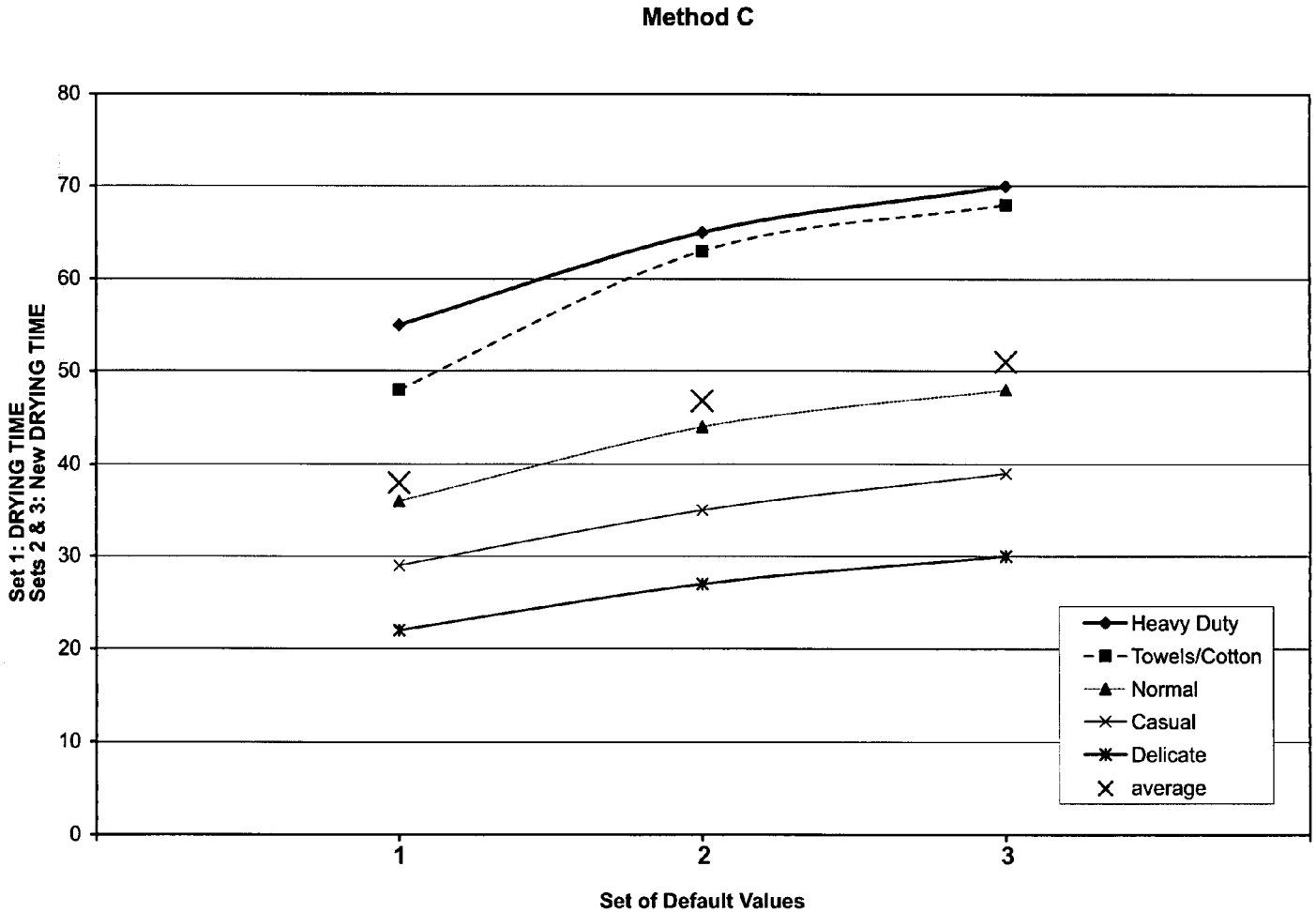
FIG. 5 a graph similar to FIG. 3, wherein DRYING TIMES and new DRYING TIMES are determined according to a Method C.

As shown in FIGS. 3-5, for all of the multiple operating cycles, the new DRYING TIMEs corresponding to the second set of default values is greater than the DRYING TIMEs corresponding to the factory-set set of default values for all of the methods. Similarly, the new DRYING TIMEs associated with the third set of default values is greater than the DRYING TIMEs and the new DRYING TIMEs associated with the first and second sets of default values, respectively. Hence, the user can select the set of default values to reflect the user's preferences. The magnitude of the increase or, conversely, decrease depends on the method and on the magnitude of the DRYING TIME MULTIPLIER or the ADDITIONAL DRY TIME. Again, these tables and graphs are provided for exemplary purposes only; the values and the quantity of the sets of default values are not limited to those shown above.

With continued reference to FIGS. 3-5, the DRYING TIMEs determined by the first set of default values for the multiple operating cycles have an average or mean DRYING TIME, as indicated by "X" markers. Further, the new DRYING TIMEs determined by the second and third sets of default values each have an average or mean new DRYING TIMEs, as indicated by the "X" markers. When the user sets the new default values by selecting one of the sets of default values from the multiple sets of default values, the DRYING TIMEs for the multiple cycles shift to the new DRYING TIMEs that correspond to the selected set of default values and, thus, the mean DRYING TIME shifts to the mean new DRYING TIME that corresponds to the selected set of default values. Because selection of the set of default values results in a mean shift, setting the new default values in this manner is advantageous for the user who desires to increase, on average, the dryness level of the dryer contents for the multiple operating cycles.

An exemplary description of setting the new default values for the dryer 10 shown in FIG. 1 follows. When the dryer 10 is manufactured, the factory-set default values for the multiple operating cycles are pre-programmed into the controller 20. The user preferably utilizes the multiple automatic operating cycles of the dryer 10 multiple times to determine whether the user is satisfied with the dryness level achieved by the multiple automatic operating cycles or prefers that the contents of the dryer on are dried to a different level of dryness. In the latter case, the user accesses the controller 20 through the user interface 30 to change the default values. For example, the user can depress the setup button 46 so that a number identifying the set of default values currently in use by the dryer 10 is displayed on the alphanumerical display 40. By using the more dry button 48 or the less dry button 54, the user can scroll through the multiple sets of default values for the common parameter(s) to incrementally increase or decrease the desired level of dryness. Once a number identifying the desired set of default values is shown on the alphanumerical display 40, the user can depress the setup button 46 again to communicate to the controller 20 that the user selects that set of default values. The controller 20 replaces the factory-set default values with the selected set of default values. By selecting the set of default values, the user simultaneously selects the new default values for all of the operating cycles having the common parameter(s). The user can repeat the above process to select another set of default values if the user's preferences change or if the user is not satisfied with the new default values.

The method of setting new default values has been described with respect to a household appliance in the form of a dryer. However, it is within the scope of the invention for the household appliance to be a washing machine, a dishwasher, or other suitable household appliance that functions according to multiple operating cycles. Further, the user interface of the household appliance can comprise any suitable combinations of buttons, indicators, and displays and is not limited to the user interface described above. For example, the user interface can comprise dials, knobs, a liquid crystal display (LCD), and/or a pressure sensitive touchpad integral with or separate from the LCD.

While the invention has been specifically described in connection with certain specific embodiments thereof, it is to be understood that this is by way of illustration and not of limitation, and the scope of the appended claims should be construed as broadly as the prior art will permit.

What is claimed is:

1. A household appliance comprising:

a controller having a processor;

a user interface in operable communication with the controller; and multiple operating cycles, where each cycle is a drying cycle for a household clothes dryer, with each operating cycle determined by the controller and having at least two sets of factory-set default values associated therewith and pre-programmed into the controller;

wherein a user of the household appliance can access the controller through the user interface to select a new set of factory-set default values from the at least two sets of factory-set default values, so that the set selected by the user replaces the existing set of default values;

wherein the default value is a DRYING time, and the controller calculates the DRYING TIME by summing a BASE DRY TIME and an ADD-ON DRY TIME, and the controller multiplies the DRYING TIME by a DRYING TIME MULTIPLIER to form a new DRYING TIME.

2. The household appliance according to claim 1, wherein the new default value comprises a set of default values selected from multiple sets of default values pre-programmed into the controller.

3. The household appliance according to claim 1, wherein the controller is configured to automatically set the new default value for the other of the at least two multiple operating cycles in response to the new default value input by the user.

4. The household appliance according to claim 1, wherein each of the multiple operating cycles is a drying cycle for a household clothes dryer.

5. The household appliance according to claim 4, wherein the new default value comprises a set of default values selected from multiple sets of default values pre-programmed into the controller.

6. The household appliance according to claim 5, wherein each set of default values contains multiple values corresponding to one of the drying cycles.

7. A household appliance comprising:

a controller having a processor;

a user interface in operable communication with the controller; and multiple operating cycles implemented by the controller, where each cycle is a drying cycle for a household clothes dryer and has at least two sets of factory-set default values associated therewith and pre-programmed into the controller;

wherein a user of the household appliance can access the controller through the user interface to select a new set of default values from the corresponding factory-set default values, so that the set selected by the user replaces the existing set of default values; and wherein the default value is a DRYING time, and the controller calculates the DRYING TIME by summing a BASE DRY TIME and an ADD-ON DRY TIME, and the controller multiplies the ADD-ON DRY TIME by a DRYING TIME MULTIPLIER and sums the product of the ADD-ON DRY TIME and the DRYING TIME MULTIPLIER with the BASE DRY TIME to form a new DRYING TIME.

8. The household appliance according to claim 7, wherein the new default value comprises a set of default values selected from multiple sets of default values pre-programmed into the controller.

9. The household appliance according to claim 7, wherein the controller is configured to automatically set the new default value for the other of the at least two multiple operating cycles in response to the new default value input by the user.

10. The household appliance according to claim 7, wherein each of the multiple operating cycles is a drying cycle for a household clothes dryer.

11. The household appliance according to claim 10, wherein the new default value comprises a set of default values selected from multiple sets of default values pre-programmed into the controller.

12. The household appliance according to claim 11, wherein each set of default values contains multiple values corresponding to one of the drying cycles.

13. A household appliance comprising:

a controller having a processor;

multiple operating cycles implemented by the controller, each operating cycle having at least one step characterized by a parameter having a factory-set default value, with the parameter being common to at least two of the multiple operating cycles and having the same factory-set default value in each of the at least two of the multiple operating cycles;

a set of factory-set default values stored in the controller and providing the factory-set default value for the parameter;

a user interface in operable communication with the controller and configured to permit a user of the household appliance to access the set of factory-set default values and permanently change the value for the factory-set default value of the parameter to form a new set of factory-set default values; and wherein the value is a DRYING time, and the controller calculates the DRYING TIME by summing a BASE DRY TIME and an ADD-ON DRY TIME, and the controller multiplies the DRYING TIME by the DRYING TIME MULTIPLIER to form a new DRYING TIME.

14. The household appliance according to claim 13, wherein the new default value comprises a set of default values selected from multiple sets of default values pre-programmed into the controller.

15. The household appliance according to claim 13, wherein each of the multiple operating cycles is a drying cycle for a household clothes dryer.

16. The household appliance according to claim 15, wherein the new default value comprises a set of default values selected from multiple sets of default values pre-programmed into the controller.

17. The household appliance according to claim 16, wherein each set of default values contains multiple values corresponding to one of the drying cycles.

18. The household appliance according to claim 13, wherein the controller is configured to automatically set the new default value for the other of the at least two multiple operating cycles in response to the new default value input by the user.

* * * * *